United States Patent [19]

Nilles

[11] 4,225,341

[45] Sep. 30, 1980

[54] REFINING IRON IN A CONVERTER

[75] Inventor: Paul E. Nilles, Embourg, Belgium

[73] Assignee: Centre de Recherches Metallurgiques-Centrum voor Research in de Metallurgie, Brussels, Belgium

[21] Appl. No.: 24,072

[22] Filed: Mar. 26, 1979

[30] Foreign Application Priority Data

Mar. 29, 1978 [BE] Belgium ..... 865462
Feb. 2, 1979 [BE] Belgium ..... 646750

[51] Int. Cl.[2] ..... C21C 5/34
[52] U.S. Cl. ..... 75/60; 75/59
[58] Field of Search ..... 75/59, 60, 46

[56] References Cited

U.S. PATENT DOCUMENTS 3,330,645 7/1967 De Moustier ..... 75/60
3,706,549 12/1972 Knuppel ..... 75/60
3,779,534 12/1973 Leroy ..... 75/60

FOREIGN PATENT DOCUMENTS 1253581 11/1971 United Kingdom ..... 75/60
1451013 9/1976 United Kingdom ..... 75/60
1451847 10/1976 United Kingdom ..... 75/60

*Primary Examiner*—P. D. Rosenberg
*Attorney, Agent, or Firm*—Holman & Stern

[57] ABSTRACT

Molten iron is refined in a converter whose bottom has tuyeres with coaxial ducts. An oxidising gas such pure oxygen is blown through the inner duct while a protective fluid such as a hydrocarbon is blown through the outer duct. During tipping of the converter from a sampling position to an emptying position after the blow, entry of molten metal is prevented by blowing fluids through the ducts, at least one of the fluids being a gas substantially consisting of $CO_2$. If a corrective blow is necessary after sampling, this may be carried out by blowing an oxidising gas through the inner ducts and $CO_2$ (alone or with hydrocarbons) through the outer ducts.

5 Claims, No Drawings

REFINING IRON IN A CONVERTER

The present invention relates to methods of refining iron, whether phosphoric or haematite iron, in a converter. It relates particularly to the case in which such refining is carried out by injecting an oxidising gas, for example pure oxygen, into the molten metal through tuyeres located in the bottom of the converter. In practice, the bottom of such converters is provided with a set of tuyeres having two coaxial ducts, the central duct serving to admit the oxidising gas, whilst the peripheral duct serves to admit a protective fluid, for example a gaseous hydrocarbon, to shield the bottom from the direct action of oxygen. After the blow, the converter is tipped into a suitable position for taking a sample, then raised and tipped in the opposite direction into a position for emptying the steel from the vessel. It is often the case that the converter remains in a vertical position for some time during this operation of raising and tipping into the emptying position. It is therefore necessary at this moment to continue blowing through the tuyeres in order to prevent them becoming blocked with the liquid steel in the converter. In order to carry out this operation, recourse is often made to injection of pure oxygen and natural gas (by the central and peripheral ducts respectively of the tuyeres), or nitrogen injection; however, in the first case such practice leads to an increase in the hydrogen content of the metal, whereas in the second case, if the hydrogen content decreases, the nitrogen content increases. In order to counter this drawback, it has been proposed to carry out this injection by means of argon, which stops any increase in the nitrogen or hydrogen contents of the metal but has the drawback of being particularly difficult in practice.

The present invention provides a refining method in which a steel works converter whose base is provided with a set of tuyeres having two coaxial ducts is used, and in which, during the operation for moving the converter into the emptying position, following its tipped positioning for sampling, a gas substantially consisting of $CO_2$ is blown through the ducts of the tuyeres.

It has been observed that such a method enables any blockage of the tuyeres to be avoided during the tipping of the converter, without running the risk of increasing the hydrogen and nitrogen contents of the steel and without being difficult to put into practice.

It has also been found advantageous to carry out this $CO_2$ injection during any possible pause of the converter, for example in vertical position, during its tipping up, and to continue this operation during the emptying operation itself.

This $CO_2$ injection may also be carried out after any corrective blowing operation carried out directly after the actual blow; this corrective blowing operaton also requires the converter to be tipped up for sampling, and is also characterised in that a strongly oxidising gas is blown through the central duct of each tuyere and a protective fluid, such as a hydrocarbon, is blown through the peripheral duct.

According to an advantageous variant of the above method the corrective blowing step is combined with the $CO_2$ blowing step mentioned above. According to this variant, during the corrective blow, e.g. from the beginning of the righting of the converter up to its emptying position, all or part of the hydrocarbon blown through the peripheral ducts of the tuyeres is replaced by $CO_2$, whilst continuing to blow a strongly oxidising gas through the central ducts of the tuyeres, this operation therefore only being followed by emptying of the converter. It has also been observed that such a method also enables a considerable reduction of the hydrogen and nitrogen contents of the steel to be achieved without additional cost.

I claim:

1. In a method of refining molten iron in a converter whose bottom contains tuyeres each comprising an inner duct and an outer duct, the method comprising the sequential steps of blowing an oxidising gas into the molten iron through the inner ducts of the tuyeres while blowing a gaseous hydrocarbon as a protective fluid through the outer ducts, tipping the converter in one direction into a sampling position, and tipping the converter in the opposite direction into an emptying position, the improvement comprising blowing a gas consisting essentially of $CO_2$ through at least the outer duct of each tuyere throughout the tipping of the converter from the sampling position to the emptying position.

2. A method as claimed in claim 1, in which the $CO_2$ blowing step is carried out after a corrective blowing operation following the first said blowing step.

3. A method as claimed in claim 1, further comprising blowing a gas consisting essentially of $CO_2$ through at least the outer duct of each tuyere is also carried out during a pause during tipping of the converter.

4. A method as claimed in claim 1, in which the blowing of the gas consisting essentially of $CO_2$ is continued during emptying of the converter.

5. A method as claimed in claim 1, further comprising, during corrective blowing after sampling, replacing at least part of the gaseous hydrocarbon blown through the outer ducts of the tuyeres by $CO_2$, whilst continuing to blow oxidising gas through the inner ducts.

* * * * *